US009919231B1

(12) United States Patent
Chin

(10) Patent No.: US 9,919,231 B1
(45) Date of Patent: Mar. 20, 2018

(54) CUBOID OR SPHERICAL HEAD FIGURINE

(71) Applicant: Peter Chin, Fontana, CA (US)

(72) Inventor: Peter Chin, Fontana, CA (US)

( * ) Notice: Subject to any disclaimer, the term of this patent is extended or adjusted under 35 U.S.C. 154(b) by 0 days.

(21) Appl. No.: 15/645,327

(22) Filed: Jul. 10, 2017

(51) Int. Cl.

| | |
|---|---|
| ***A63H 3/48*** | (2006.01) |
| ***A63H 11/00*** | (2006.01) |
| ***A63H 33/26*** | (2006.01) |
| ***A63H 11/18*** | (2006.01) |

(52) U.S. Cl.
CPC ..... *A63H 3/48* (2013.01); *A63H 11/18* (2013.01); *A63H 33/26* (2013.01)

(58) Field of Classification Search
CPC . A63H 3/36; A63H 3/48; A63H 11/00; A63H 11/18; A63H 33/26
USPC ..... 446/129, 139, 330, 376, 377, 379, 390
See application file for complete search history.

(56) References Cited

U.S. PATENT DOCUMENTS 681,974 A * 9/1901 Purvis ..... A63H 3/48 223/66
2,780,030 A * 2/1957 Beebe ..... A63H 3/20 446/377
2,799,970 A * 7/1957 Baggott ..... A63H 3/46 403/119
3,452,473 A * 7/1969 Convertine ..... A63H 11/06 446/100
4,708,690 A * 11/1987 Kulesza ..... A63H 11/02 446/326
5,628,668 A * 5/1997 Takemae ..... A63H 11/18 446/326
5,836,803 A * 11/1998 Hamlin ..... A63H 3/46 446/317
6,129,606 A * 10/2000 Yuen ..... A63H 3/48 446/325
6,652,353 B1 * 11/2003 Lund ..... A63H 30/00 446/297
6,682,387 B2 * 1/2004 Choi ..... A63H 11/00 446/129
6,837,769 B1 * 1/2005 Skov ..... A63F 7/0612 273/317.3
6,899,589 B1 * 5/2005 Lund ..... A63H 11/02 446/351
6,918,811 B1 * 7/2005 Wang ..... A63H 13/04 180/8.1
8,956,198 B1 * 2/2015 Chang ..... A63H 11/18 446/433
9,120,512 B2 * 9/2015 Shirokura ..... B62D 57/032
9,675,896 B2 * 6/2017 Morikawa ..... A63H 11/18
2002/0081937 A1 * 6/2002 Yamada ..... A63H 3/48 446/175

(Continued)

*Primary Examiner* — Alexander Niconovich
(74) *Attorney, Agent, or Firm* — Clement Cheng

(57) ABSTRACT

A cuboid head figure has a head portion. The head portion is a cuboid and has a head front panel, a head rear panel, a head bottom panel, and a head top panel. The head front panel is parallel to the head rear panel. The head bottom panel is parallel to the head top panel. A plurality of magnets are installed in the head portion on an inside surface of the head portion. A slot is formed on the head rear panel and the head bottom panel. The head rear panel is perpendicular to the head bottom panel. A retainer connects to the head portion through the slot. The retainer has a retainer upper section that protrudes into the slot and engages the inside surface of the head portion. The retainer also has retainer side extensions that extend laterally from the retainer upper section.

16 Claims, 2 Drawing Sheets

(56) References Cited

U.S. PATENT DOCUMENTS

| | | | | |
|---|---|---|---|---|
| 2003/0017779 | A1* | 1/2003 | Sakai | A63H 11/18<br>446/226 |
| 2003/0166374 | A1* | 9/2003 | Nelson | A63H 3/04<br>446/379 |
| 2004/0127141 | A1* | 7/2004 | Sakai | A63H 11/18<br>446/317 |

* cited by examiner

CUBOID OR SPHERICAL HEAD FIGURINE

FIELD OF INVENTION

The present invention is in the field of figurines, namely a cuboid or spherical head figurine.

DISCUSSION OF RELATED ART

A variety of different action figures and positionable figurines have been made in the prior art. Many dolls, positionable figurines and toys have a head and body with appendages that can be placed in a variety of different configurations.

SUMMARY OF THE INVENTION

A cuboid or spherical head figurine has a head portion and a body portion. The head portion is a cuboid and has a head front panel, a head rear panel, a head bottom panel, and a head top panel. The head front panel is parallel to the head rear panel. The head bottom panel is parallel to the head top panel. A plurality of magnets are installed in the head portion on an inside surface of the head portion.

A slot is formed on the head rear panel and the head bottom panel. The head rear panel is perpendicular to the head bottom panel. A retainer connects to the head portion through the slot. The retainer has a retainer upper section that protrudes into the slot and engages the inside surface of the head portion. The retainer also has retainer side extensions that extend laterally from the retainer upper section. The retainer has a retainer lower portion. The body portion connects to the retainer. The body portion has a foot. The foot has a lower foot magnet installed therein. A spring biases the retainer toward the body portion. The body portion has a body top surface, body front surface, body rear surface and body bottom surface. The spring connects to the retainer lower portion and biases the retainer toward the body portion to retract the retainer into the body portion. The retainer side extensions retain the retainer inside the body portion.

Figure 1:
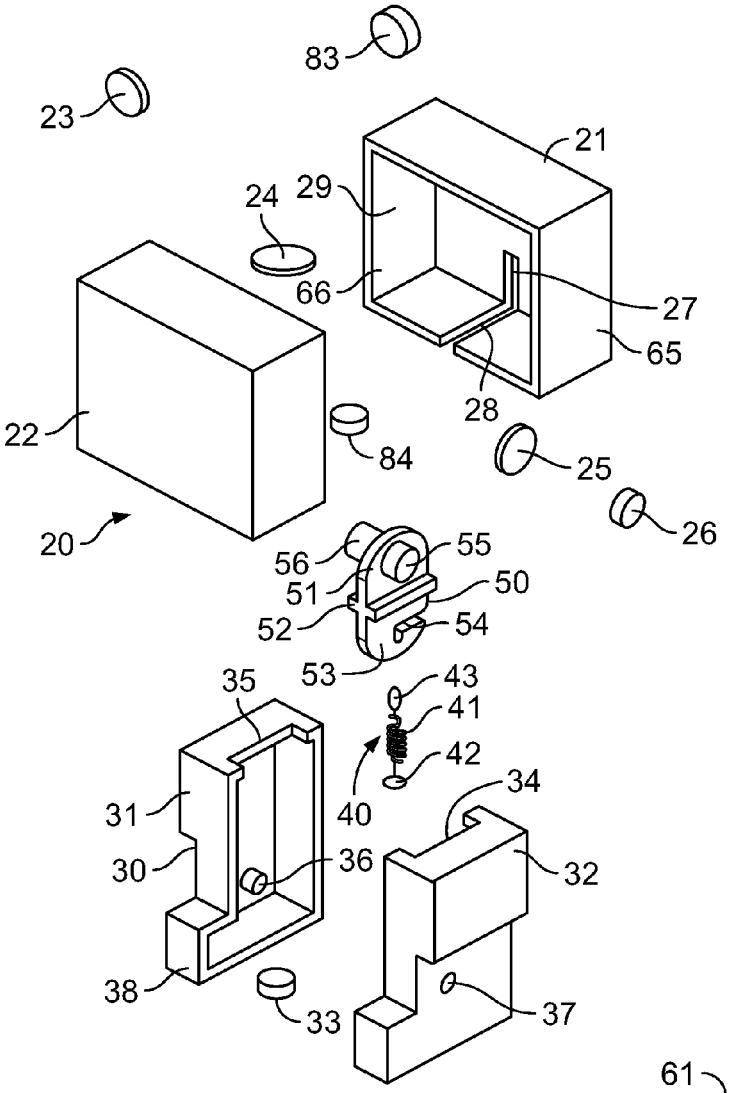
FIG. 1 is an exploded view of the present invention.
Figure 2:
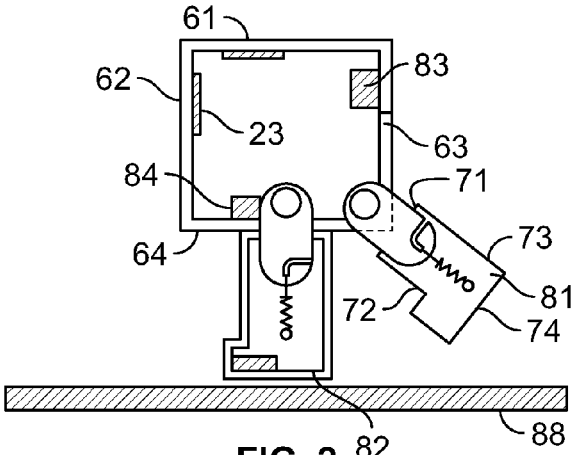
FIG. 2 is a side cross section view of the present invention.

The following callout list of elements can be a useful guide in referencing the element numbers of the drawings.

20 Head
21 Front Head Section
22 Rear Head Section
23 Front Metal Piece
24 Top Metal Piece
25 Side Metal Piece
26 Left Side Magnet
27 Rear Slot
28 Bottom Slot
29 Cavity
30 Legs
31 Right Body Shell
32 Left Body Shell
33 Lower Foot Magnet

34 Left Body Slot
35 Right Body Slot
36 Right Lower Post
37 Left Lower Post
38 Toe Extension
40 Spring
41 Helical Body
42 Lower Loop
43 Upper Loop
50 Retainer
51 Retainer Upper Section
52 Retainer Side Extensions
53 Retainer Lower Hook
54 Retainer Lower Hook Slot
55 Left Hinge Protrusion
56 Right Hinge Protrusion
61 Head Top Panel
62 Head Front Panel
63 Head Rear Panel
64 Head Bottom Panel
65 Head Left Panel
66 Head Right Panel
71 Body Top Surface
72 Body Front Surface
73 Body Rear Surface
74 Body Bottom Surface
81 Rear Position
82 Front Position
88 Metal Sheet

DETAILED DESCRIPTION OF THE PREFERRED EMBODIMENT

The present invention is a figurine that has a head 20 and a body 30. Both the head and the body are hollow and have a cavity 29. The body is attached to the head. The head portion 20 preferably a cuboid shape having six orthogonal faces including the head top panel 61, the head front panel 62, the head rear panel 63, the head bottom panel 64, the head left panel 65 and the head right panel 66. The head portion 20 can be formed of a pair of sections, namely a front head section 21 and a rear head section 22. The head and the legs can have a screenprinted exterior surface and be formed of plastic injection molded pieces. The head and legs can have magnets and metal parts to allow the magnets to attract to the metal parts. The metal parts can be formed as inserts that adhere or are snap together or otherwise secured to the inside of the head and legs. The metal parts and magnets allow stacking and customizable configuration for figurine display. The figurines can be magnetically mounted to a metal sheet 88 for display in a variety of different configurations.

The pair of head sections could also be made as a left head section and a right head section, but if the rear head section is formed as a hollow shell, then a rear slot 27 and a bottom slot 28 can be formed in the hollow shell. The rear slot 27 and the bottom slot 28 can merge into a lower rear slot. The front metal piece 23 is placed in the head of the figurine. The front metal piece 23 is installed such as by adhesive to an inside surface of the head front panel 62. The head front panel has an outside surface imprinted with a face of the figurine. The head top panel 61 is also imprinted with the figurine theme. The head rear panel 63 opposes the head from panel 62. The head bottom panel 64 opposes the head top panel 61. The top metal piece 24 is mounted on an inside surface of the head top panel 61. The head panels are configured orthogonal to each other. The rear slot 27 is formed in the lower middle portion of the head rear panel 63. The bottom slot 28 is formed in the rear middle portion of the head bottom panel 64. A side metal piece 25 adheres to an inside surface of the head on a cheek portion of the head. Similarly, a left side magnet 26 can be mounted on an inside portion of the head left panel 65. Analogously, a right side magnet could also be mounted on an inside portion of the head right panel.

A retainer 50 can be formed as a spring loaded retainer that connects the head to the body and legs. The retainer 50 can have a retainer upper section 51 formed as a flat extension that extends into the bottom slot 28. The flat extension can move along the bottom slot 28 and the rear slot 27. The retainer 50 also has a pair of retainer side extensions 52. The top surface of the retainer side extensions 52 press against the external surface of the head bottom panel 64. The retainer side extensions 52 have a width that is greater than the width of the bottom slot 20 and the rear slot 27. The retainer upper section 51 can swivel from the bottom slot 28 to the rear slot 27. The retainer upper section 51 has a pair of hinge protrusions extending laterally at an orthogonal angle to the retainer upper section 51. The left hinge post 55 extends from an opposite side of the retainer upper section 51 than the right hinge protrusion 56.

The retainer lower hook slot 54 is defined at the retainer lower hook 53 which extends downwardly from the retainer upper section 51. The retainer lower hook slot 54 receives the upper loop 42 of the spring 40. The spring 40 generally has a helical body 41 that extends upwardly to an upper loop 43 and lower loop 42. The upper loop 43 is hooked to the retainer lower hook slot 54 and the lower loop 42 is looped to the lower post. The lower post is formed of a pair of posts, namely a right lower post 36 that connects to a left lower post 37. The spring 40 is in tension and pulls the lower post toward the head. The retainer side extensions 52 are retained within the body 30 in the right body slot 35 and the left body slot 34. The right body slot 35 is formed on the right body shell 31 and the left body slot 34 is formed on the left body shell 32. The body is therefore held toward the head. The body top surface 71 abuts the head bottom panel 64 when the figurine is in a standing position also called the front position 82. When the body is in a rear position 81 engaging with the rear slot 27, the head is tilted upward and the body top surface 71 abuts the head rear surface 63. Thus, the figurine is configurable between two positions where the body makes the figurine look like it is standing, then the body makes the figurine look like it is flying forward. The legs 30 also have a toe extension 38. The lower foot magnet 33 can be placed within the hollow of the toe extension 38. The legs 30 are formed from the right body shell 31 and the left body shell 32, but preferably have a common or continuous body top surface 71, a body front surface 72, a body rear surface 73, and a body bottom surface 74.

Figure 3:
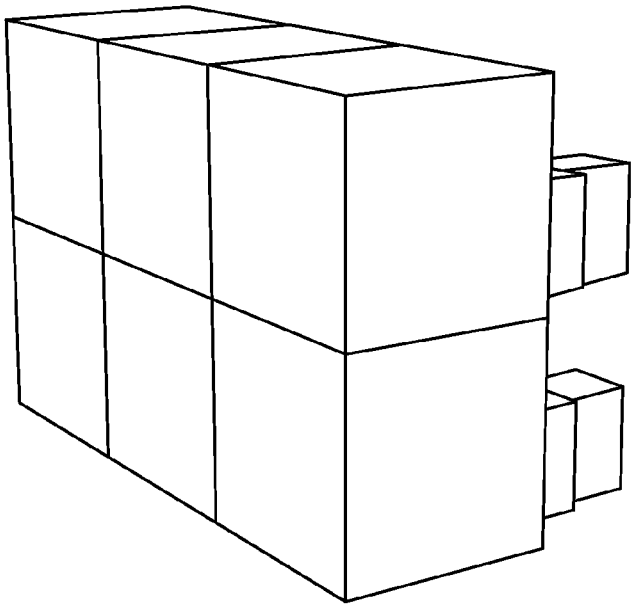
FIG. 3 is a prone configuration showing that the figurines interlock together at the magnet interfaces.
Figure 4:
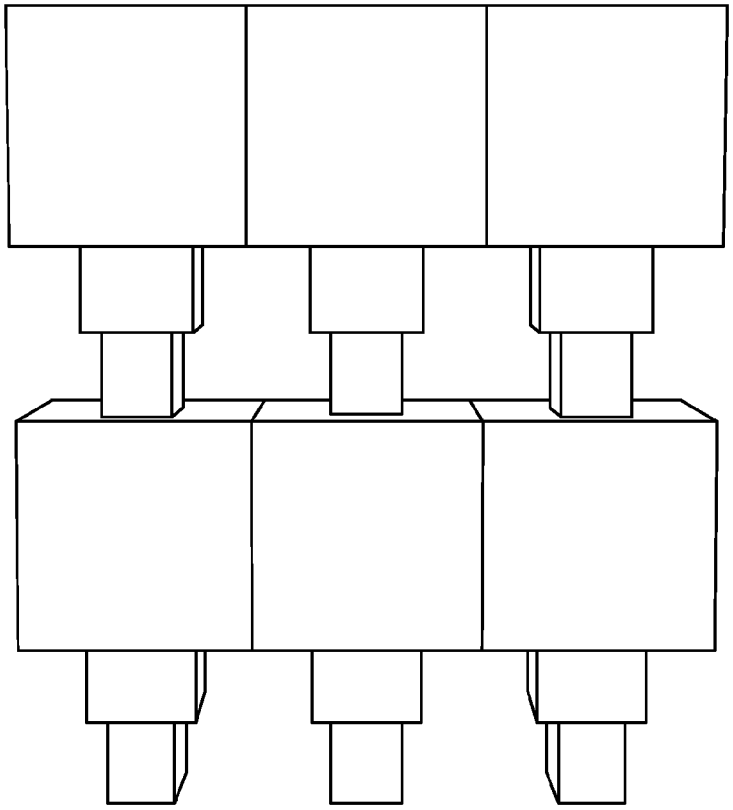
FIG. 4 is a standing configuration showing that the figurines interlock together at the magnet interfaces.

The figurines can be stacked in an array. FIG. 3 shows a prone configuration showing that the figurines interlock together at the magnet interfaces. For example, six figurines can have their faces facing forward while the feet are attracted to the metal board. FIG. 4 is a standing configuration showing that the figurines interlock together at the magnet interfaces to have a grid array arrangement. The figures are facing forward and can have the rear head surfaces attract to the metal board so that all of the figurines are standing together in a grid array arrangement.

The invention claimed is:

1. A cuboid head figure comprising:

a. a head portion, wherein the head portion is a cuboid and has a head front panel, a head rear panel, a head bottom panel, and a head top panel, wherein the head front panel is parallel to the head rear panel, wherein the head bottom panel is parallel to the head top panel;

b. a plurality of magnets installed in the head portion on an inside surface of the head portion;

c. a slot formed on the head rear panel and the head bottom panel, wherein the head rear panel is perpendicular to the head bottom panel;

d. a retainer connecting to the head portion through the slot, wherein the retainer has a retainer upper section that protrudes into the slot and engages the inside surface of the head portion, wherein the retainer also has retainer side extensions that extend laterally from the retainer upper section, wherein the retainer has a retainer lower portion;

e. a body portion, wherein the body portion connects to the retainer, wherein the body portion has a foot; and f. a spring biasing the retainer toward the body portion, wherein the body portion has a body top surface, body front surface, body rear surface and body bottom surface, wherein the spring connects to the retainer lower portion and biases the retainer toward the body portion to retract the retainer into the body portion, wherein the retainer side extensions retain the retainer inside the body portion, wherein the spring has a helical body.

2. The cuboid head figure of claim 1, wherein the retainer lower portion is formed as a retainer lower hook that defines a retainer lower hook slot, wherein the spring connects to the retainer lower hook slot.

3. The cuboid head figure of claim 2, wherein the helical body has an upper loop extending upwardly from the helical body and a lower loop extending downwardly from the helical body, wherein the upper loop is hooked to the retainer lower hook slot and the lower loop is looped to a lower post.

4. The cuboid head figure of claim 1, further comprising metal pieces mounted on the inside surface of the head portion.

5. The cuboid head figure of claim 1, wherein the retainer upper section has a pair of retainer side extensions extending laterally from the retainer upper section.

6. The cuboid head figure of claim 1, wherein a side metal piece adheres to an inside surface of the head on a cheek portion of the head.

7. The cuboid head figure of claim 1, wherein a left side magnet can be mounted on an inside portion of the head left panel.

8. The cuboid head figure of claim 1, wherein a body top surface abuts the head bottom panel when the figure is in a front position.

9. The cuboid head figure of claim 1, wherein the foot has a lower foot magnet installed therein, and further including a metal sheet, wherein the lower foot magnet can magnetically mounted to the metal sheet for display in a variety of different configurations.

10. The cuboid head figure of claim 9, wherein the retainer lower portion is formed as a retainer lower hook that defines a retainer lower hook slot, wherein the spring connects to the retainer lower hook slot.

11. The cuboid head figure of claim 10, wherein the helical body has an upper loop extending upwardly from the helical body and a lower loop extending downwardly from the helical body, wherein the upper loop is hooked to the retainer lower hook slot and the lower loop is looped to a lower post.

12. The cuboid head figure of claim 9, further comprising metal pieces mounted on the inside surface of the head portion.

13. The cuboid head figure of claim 9, wherein the retainer upper section has a pair of retainer side extensions extending laterally from the retainer upper section.

14. The cuboid head figure of claim 9, wherein a side metal piece adheres to an inside surface of the head on a cheek portion of the head.

15. The cuboid head figure of claim 9, wherein a left side magnet can be mounted on an inside portion of the head left panel.

16. The cuboid head figure of claim 9, wherein a body top surface abuts the head bottom panel when the figure is in a front position.

* * * * *